US007097464B1

(12) United States Patent
McHugh et al.

(10) Patent No.: US 7,097,464 B1
(45) Date of Patent: Aug. 29, 2006

(54) LGA CONNECTOR

(75) Inventors: Robert G. McHugh, Golden, CO (US); Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/055,130

(22) Filed: Feb. 9, 2005

(51) Int. Cl.
*H01R 12/00* (2006.01)

(52) U.S. Cl. ..... 439/73; 439/331

(58) Field of Classification Search ..... 439/73, 439/331

See application file for complete search history.

(56) References Cited

U.S. PATENT DOCUMENTS 6,685,494 B1 * 2/2004 McHugh et al. ..... 439/342
6,716,050 B1 * 4/2004 Ma et al. ..... 439/331
6,752,636 B1 * 6/2004 Ma ..... 439/73
6,776,625 B1 * 8/2004 Ma ..... 439/73
6,780,024 B1 * 8/2004 Ma ..... 439/73
6,780,025 B1 * 8/2004 Ma et al. ..... 439/73
6,799,978 B1 * 10/2004 Ma et al. ..... 439/73
6,832,919 B1 * 12/2004 Ma et al. ..... 439/73
6,848,929 B1 * 2/2005 Ma ..... 439/331
6,875,038 B1 * 4/2005 McHugh et al. ..... 439/331
6,877,993 B1 * 4/2005 Palaniappa et al. ..... 439/73
2004/0095693 A1 5/2004 Shirai et al.

* cited by examiner

*Primary Examiner*—Gary F. Paumen
(74) *Attorney, Agent, or Firm*—Wei Te Chung

(57) ABSTRACT

An LGA connector includes an insulative housing with a plurality of electrical terminals received therein, a stiffener defining a cavity in a middle portion thereof for partially receiving the housing therein. The insulative house is generally rectangular-shaped, which defines a surrounding wall, each corner of the surrounding wall defines a stopper which protruding outwardly. In assembly, when the housing is pushed into the cavity of the stiffener to a predetermined position, the stoppers will abut against the bottom portion for preventing the housing from being excessively pushed into the cavity or being push out of the cavity in a underside direction.

16 Claims, 5 Drawing Sheets

LGA CONNECTOR

BACKGROUND OF THE INVENTION

1. Field of the Invention

The present invention relates generally to pressure contact connectors, and more particularly to a land grid array ("LGA") connector that applies a stiffener to strengthen a housing.

2. The Background of the Invention

Connectors for removably mounting an LGA chip on a PCB are known as LGA connectors. A typical LGA electrical connector includes an insulative housing, a multiplicity of terminals received in the housing in a rectangular array, a fasten frame partially surrounding the housing, a metal clip attached to the fastening frame, and an operational lever.

An typical LGA connector includes an insulative housing, a stiffener defining a cavity in a middle portion thereof for partially receiving the housing, a metal clip pivotably attached to an end of the stiffener, and a lever pivotably attached to an opposite end of the stiffener. The clip has an engaging portion extending outwardly and arcuately from an end thereof. The housing defines a generally rectangular room for receiving an electronic package such as an LGA central processing unit (CPU) therein. When the lever is pushing downwardly, the lever will press the engaging portion for urging the CPU to electrically connect with the connector.

However, due to that the housing is just pushed into the stiffener, there are no other auxiliary measures to promise a firm and reliable combination of the housing and the stiffener, therefore, the housing will probably move up and down in the cavity of the stiffener, or flee out of the stiffener in a underside direction in the course of conveyance or when housing is pushed down by mistake.

What is needed, therefore, is an LGA connector that housing can be surely fixed in the cavity of the stiffener.

SUMMARY OF THE INVENTION

The present invention provides an LGA connector includes an insulative housing with a plurality of electrical terminals received therein, a stiffener defining a cavity in a middle portion thereof for partially receiving the housing therein. The insulative house is generally rectangular-shaped, which defines a surrounding wall, each corner of the surrounding wall defines a stopper which protruding outwardly. In assembly, when the housing is pushed into the cavity of the stiffener to a predetermined position, the stoppers will abut against the bottom portion for preventing the housing from being excessively pushed into the cavity or being pushed out of the cavity in a underside direction.

Other advantages and novel features will become more apparent from the following detailed description of the preferred embodiment of the present invention when taken in conjunction with the accompanying drawings.

DESCRIPTION OF THE PREFERRED EMBODIMENT OF THE INVENTION

Reference will now be made to the drawings to describe of a preferred embodiment of the present invention in detail.

Figure 1:
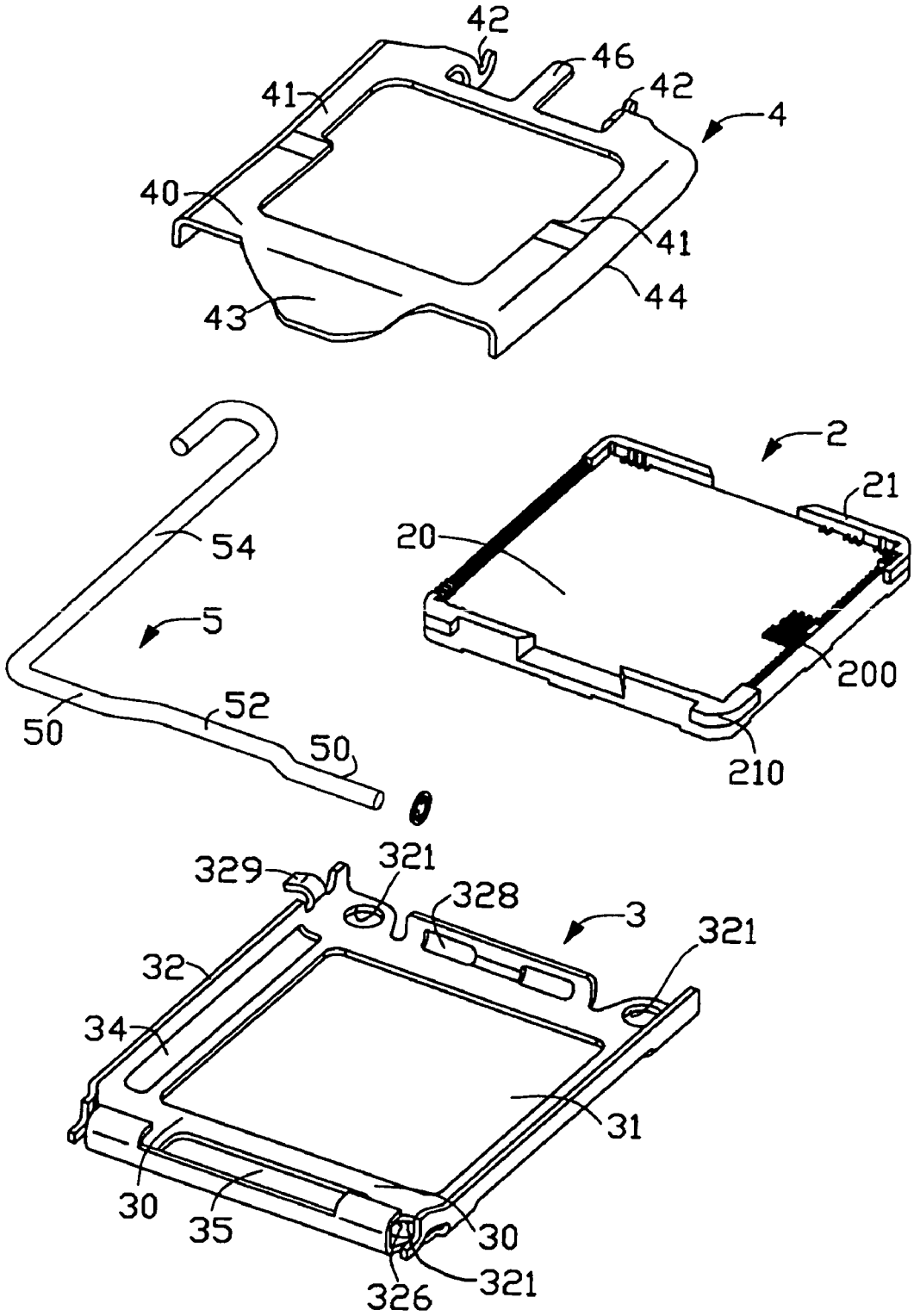
FIG. 1 is an exploded, isometric view of an LGA connector of one preferred embodiment of the present invention.
Figure 2:
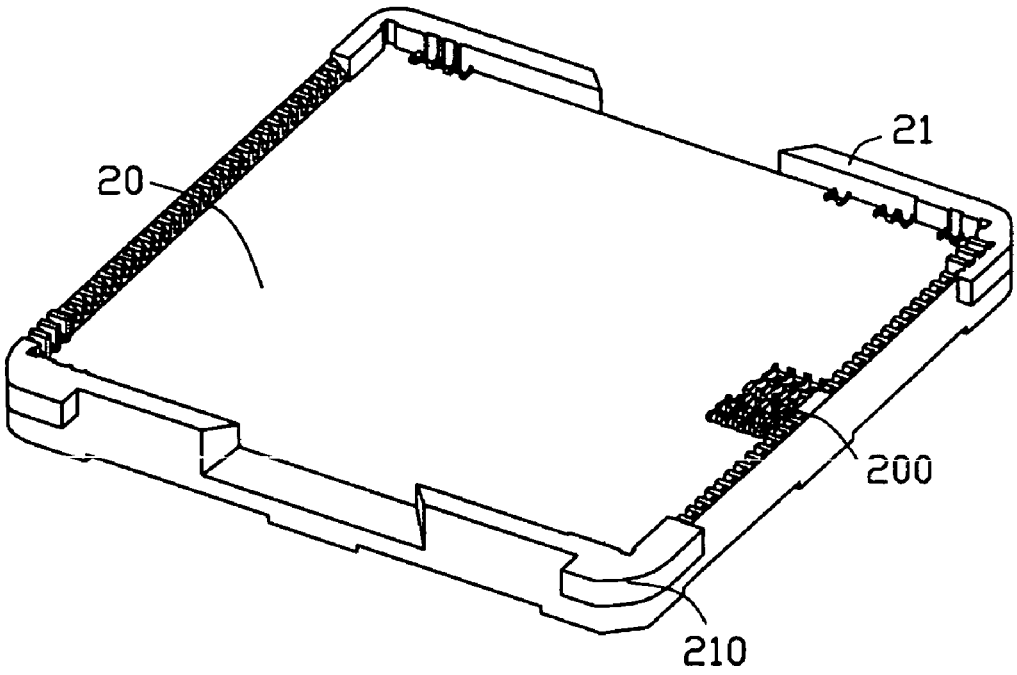
FIG. 2 is an enlarged view of the housing of FIG. 1.
Figure 3:
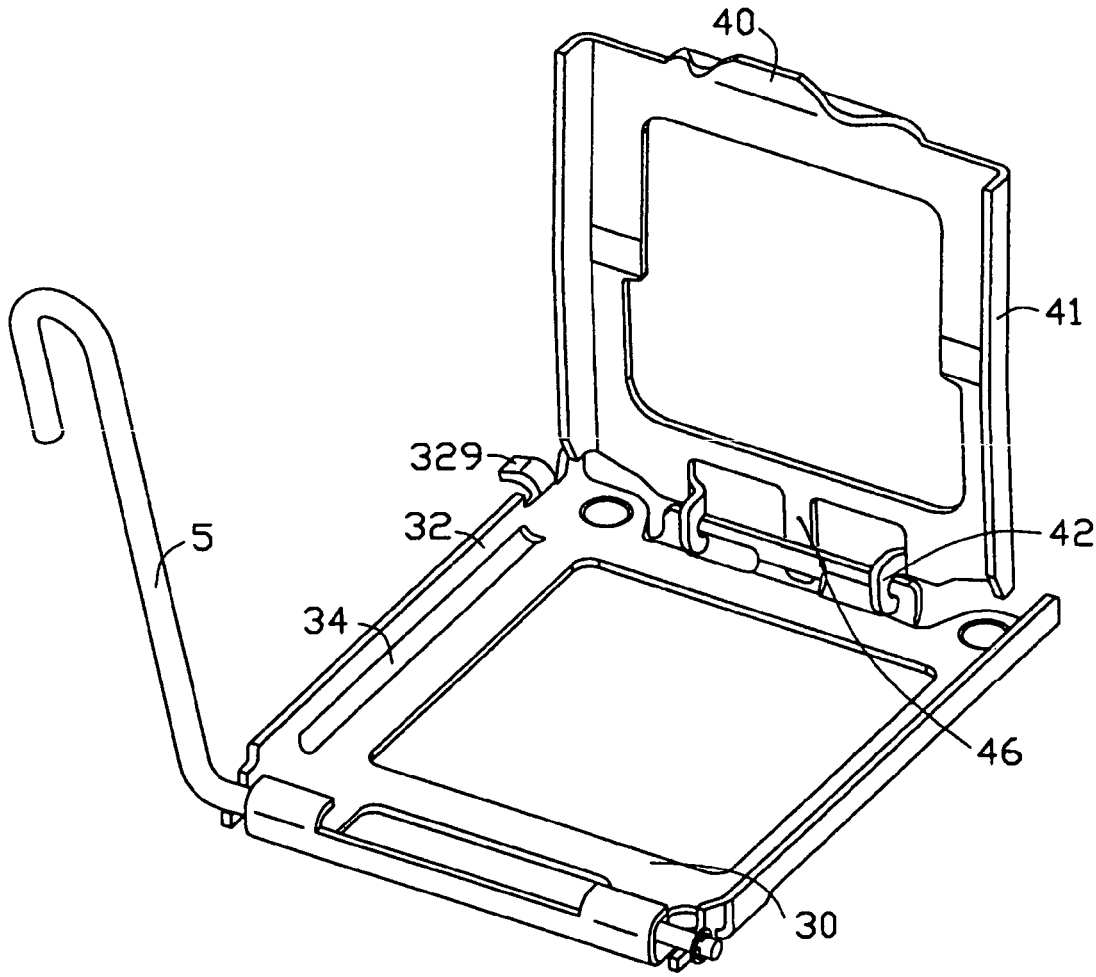
FIG. 3 is an assembled view of the clip and the stiffener of FIG. 1, showing in a opening position.
Figure 4:
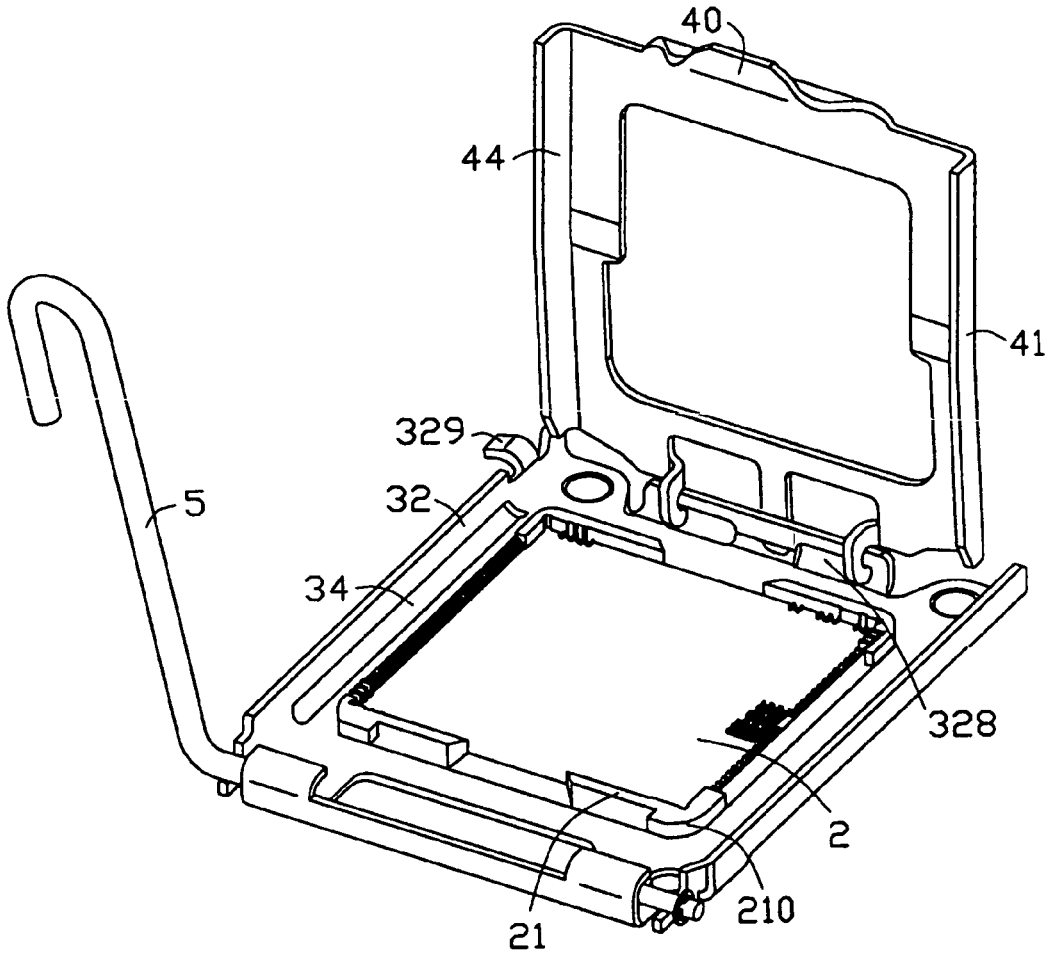
FIG. 4 is an assembled view of connector of FIG. 1, showing in a opening position.
Figure 5:
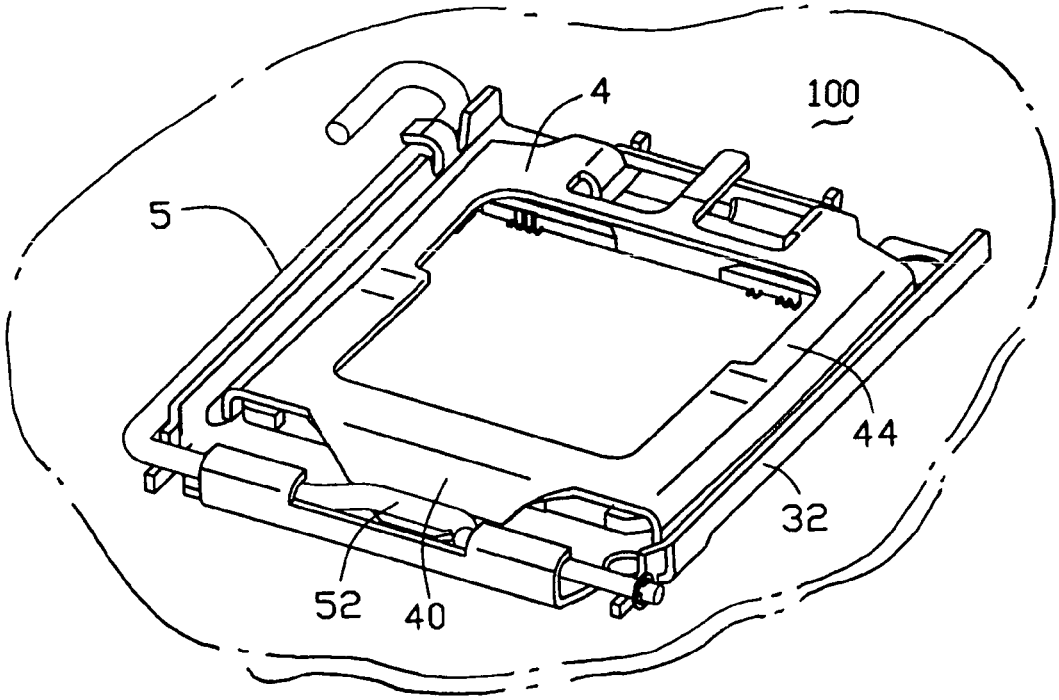
FIG. 5 is an assembled view of the LGA connector y of FIG. 1, showing in a closed position.

Referring to FIG. 1 to FIG. 4, an LGA connector 1 in accordance with a preferred embodiment of the present invention is adapted for electrically connecting an LGA chip with a circuit substrate such as a printed circuit board (PCB) 100 (FIG. 5). The connector 1 includes a generally rectangular insulative housing 2, a plurality of electrical terminals (not shown) received in the housing 2, a metal stiffener 3 partially surrounding the housing 2 to enforce the housing 2, a lever 5 pivotably received in an end of the stiffener 3, and a metal clip 4 pivotably mounted to an opposite end of the stiffener 3.

The housing 2 includes a rectangular main body 20, a surrounding wall 21 enclosing the main body 20, the surrounding wall 21 extending over the main body 20. The main body 20 together with the surrounding wall 21 forms a room for receiving a CPU therein. The main body 20 defines a multiplicity of passageways 200 arranged in a rectangular array for receiving a corresponding number of terminals (not shown) therein, each corner of the surrounding wall 21 defines a stopper 210 protruding outwardly.

The stiffener 3 has a bottom portion 30 which defines a cavity 31 in the middle thereof, and a lateral side 32 extending upwardly from the periphery of the bottom portion 30. The bottom portion 31 and the lateral side 32 enclose a receiving space for partially receiving the housing 2 therein. Two opposite grooves 34 are respectively defined at the two opposite sides of the cavity 31. An elongate chamber 326 is defined in an end of the stiffener 32. A pair of spaced assembling holes 328 are defined in an opposite end of the stiffener 32. The bottom portion 30 defines a slot 35 in an end near to the chamber 326. Opposite to the chamber 326, an ear 329 extends bendly and laterally from an edge of the lateral sides 32.

The clip 4 has a generally rectangular planar body 40 which defines a window in the middle thereof. An engaging portion 43 extending arcuately from an end of the planar body 40 thereof. A pair of spaced hooks 42 extending from an opposite end of the planar body 40 corresponding to the two assembling holes, 328 of the stiffener 3, and a tail 46 located between the hooks 42. Two urging sides 41 interconnect the two ends of the clip 4, the two urging portion 41 are bending downwardly in the middle portion therefrom. Two mounting sides 44 extend downwardly from the outer edges of the two urging sides 41 respectively for cooperating with the two grooves 34 located in the stiffener 3.

The lever 5 has a pair of locating portion 50 pivotably received in the chamber 326 of the stiffener 3, an actuating portion 52 between the two locating portions 50, and an operating portion 54 extending perpendicularly from an end of one of the locating portions 50. The operating portion 54 is disposed at an out side of the stiffener 22 in assembly.

Referring to FIG. 4 and FIG. 5, in assembly, when the housing 2 is pushed into the cavity 31 of the stiffener 3, the surrounding wall 21 will interference with inner side of the bottom portion 30. As the housing 2 being further pushed into the stiffener 3, the four stoppers 210 will abut against the top side of the bottom portion 30 so as to prevent the housing 2 from being excessively pushed in or being pushed out of the stiffener 3 in an underside direction. After the housing 2 being surely positioned in the stiffener 3, the lever 5 is attached to an end of the stiffener 3 with the two locating portion 50 pivotably received in the chamber 326. The clip 4 is attached to an opposite end of the stiffener 3 with the two hooks 42 pivotably received in the two assembling holes 328. In order to put the CPU into the housing 2, the clip 4 is rotated to a perpendicular position as the tail 46 abuts against lateral side 32 to stop the clip 4 from over rotation, and the lever 5 is also rotated away from ear 329. The CPU is then put into the housing 2 so that it rests on the terminals of the housing 2. When the clip 4 is rotated down to a horizontal position, the engaging portion 40 is received in the slot 35 and the two mounting sides 44 are received in the two grooves 34 respectively, and the middle portion of the two urging sides 41 engage with the CPU. When the lever 5 is rotated towards the ear 329, the actuating portion 52 applies a stress upon the engage portion 40 to actuate the middle portion of the two urging sides 41 to press down the CPU, finally the operating portion 54 is positioned under the ear 229 so that the CPU is surely and electrically assembled into the connector 1.

Due to that the housing 2 has four stoppers protruding outwardly from the four corners respectively so that the housing 2 may be positioned in a predetermined place where the four stoppers somewhat engage with the bottom portion 30. By abutting against the top side of the bottom portion 30, the four stoppers can also prevent the housing 2 from being excessively pushed into the cavity 31 or fleeing out of the cavity 31 in an underside direction in the course of conveyance or when housing is pushed down by mistake.

It can be noted that when the connector is mounted to the printed circuit board 100, the terminals are soldered on the printed circuit board 100 via the associated solder balls (not shown) which are already attached to the tails of the terminals, and the stiffener 3 is fixed to the printed circuit board 100 via screws (not shown) extending through the screw holes 321 (FIG. 1) in the bottom portion 30 of the stiffener 3 and the corresponding through holes (not shown) in the printed circuit board 100. Under that situation, the engagement between the stoppers 210 and the top side of the bottom portion 30 no longer occurs. Instead, the housing 2 and the stiffener 3 can be deemed as two discrete pieces in a relatively loose confrontation. Therefore, forces derived from the clip 4 and the lever 5 during operation and transferred/applied to the stiffener 3 will not significantly transferred to the housing 2 by reason of (a) the stiffener 3 having its own fixation with regard to the printed circuit board 100 for absorbing the stresses, and (b) a relatively insignificant fixation between the housing 2 and the stiffener 3. Accordingly, the solder joint resulting from the solder balls (not shown) and the printed circuit board 100 may not be improperly damaged for a long time or repeated operation. Oppositely, without direct fixation between the stiffener 3 and the printed circuit board 100, the forces due to operation of the clip 4 may be fully transferred to the housing and damage the solder joints between the terminals and the printed circuit board 100.

Although the present invention has been described with reference to a particular embodiment, it is not to be construed as being limited thereto. Various alterations and modifications can be made to the embodiment without in any way departing from the scope or spirit of the present invention as defined in the appended claims. The above embodiment illustrate the scope of the invention but do not restrict the scope of the invention.

We claim:

1. An LGA connector, comprising:

an insulative housing having a plurality of conductive terminals received therein, respectively;

a stiffener detachably disposed around the housing; and a clip and a lever movably coupled to the stiffener to cooperatively hold an electronic component onto the housing; wherein the housing is provided with at least one stopper capable of abutting against the stiffener during mounting of the housing onto the stiffener, so as to void excessive insertion of the housing with respect to the stiffener.

2. The LGA connector as claimed in claim 1, wherein the housing; comprises a rectangular main body, and a surrounding wall enclosing and protruding over the main body.

3. The LGA connector as claimed in claim 2, wherein four stoppers protrude outwardly from four corners of the surrounding wall of the housing, respectively.

4. The LGA connector as claimed in claim 1, wherein the clip comprises two opposite urging sides, the urging sides each being bent downwardly at a middle portion thereof.

5. The LGA connector as claimed in claim 4, wherein the urging sides of the clip each comprise a mounting side extending downwardly from an outer edge thereof.

6. The LGA connector as claimed in claim 5, wherein the stiffener comprises a bottom portion defining a cavity in a middle thereof, and defines two opposite grooves at two opposite sides of the cavity for partially receiving the two mounting sides of the clip, respectively.

7. The LGA connector as claimed in claim 1, wherein two lateral sides extending upwardly from a periphery of the bottom of the stiffener, the bottom and the lateral sides jointly enclosing a receiving space for partially receiving the housing therein.

8. The LGA connector as claimed in claim 1, wherein the lever is pivotally attached to an end of the stiffener and the clip is pivotally attached to the opposite end of the stiffener.

9. An electrical connector, comprising:

a stiffener defining a cavity in a bottom thereof;

an electrically dielectric housing embedded with a plurality of contacts and being provided with at least one protrusion at a periphery thereof compliantly mounted to the cavity, the protrusion being seated on the bottom of the stiffener circling around the cavity so as to prevent the housing from being excessively pressed into the cavity;

a clip mounted to the stiffener for releasably retaining an electronic component thereunder; and a lever movably coupled to the stiffener for locking the clip in position.

10. The electrical connector as claimed in claim 9, wherein four stoppers protrude outwardly from four corners of the housing in an upper portion thereof, respectively.

11. The electrical connector as claimed in claim 10, wherein the clip defines an engaging portion extending arcuately and laterally from a side thereof, and the stiffener correspondingly defines a slot in an end thereof for partially receiving the engaging portion of the clip.

12. An electrical connector assembly comprising:

a printed circuit board;

an insulative housing with a plurality of terminals therein, each of said terminals having a tail portion soldered to the printed circuit board via a corresponding solder ball;

a metallic stiffener associatively surrounding said housing and fastened to the printed circuit board; and a clip mounted to the stiffener for retaining an electronic component to the housing in tension; wherein forces, due to tensional operation of the clip, applied and transferred to the stiffener, are substantially absorbed by the printed circuit board.

13. The electrical connector assembly as claimed in claim 12, wherein the housing and the stiffener cooperate with each other in a relatively loose confrontation manner when the housing and the stiffener are mounted to the printed circuit board so as to not to significantly transfer forces imposed upon the stiffener, due to operation of the clip, to the housing for protecting solder joints between the terminals and the printed circuit board.

14. The electrical connector assembly as claimed in claim 12, wherein the stiffener defines an opening in which said housing is received, and said housing further defines at least one stopper protruding outwardly and transversely beyond the opening and above said stiffener so as to prevent withdrawn of the housing from the stiffener during delivery.

15. The electrical connector assembly as claimed in claim 12, wherein said clip is pivotally mounted to the stiffener.

16. The electrical connector assembly as claimed in claim 12, wherein said housing define, a plurality of passageways to receive the corresponding terminals therein, respectively.

* * * * *